US008296870B2

(12) United States Patent
Kannengiesser

(10) Patent No.: US 8,296,870 B2
(45) Date of Patent: Oct. 30, 2012

(54) TOILET SEAT

(75) Inventor: Thomas Kannengiesser, Saarlouis (DE)

(73) Assignee: Villeroy & Boch AG, Mettlach (DE)

( * ) Notice: Subject to any disclaimer, the term of this patent is extended or adjusted under 35 U.S.C. 154(b) by 179 days.

(21) Appl. No.: 12/442,195

(22) PCT Filed: Jan. 19, 2008

(86) PCT No.: PCT/EP2008/000393

§ 371 (c)(1),
(2), (4) Date: Mar. 20, 2009

(87) PCT Pub. No.: WO2008/125156

PCT Pub. Date: Oct. 23, 2008

(65) Prior Publication Data

US 2010/0017946 A1 Jan. 28, 2010

(30) Foreign Application Priority Data

Apr. 17, 2007 (DE) ..... 20 2007 005 626 U

(51) Int. Cl.
*A47K 13/00* (2006.01)

(52) U.S. Cl. ..... 4/234

(58) Field of Classification Search ..... 4/239, 242.1, 4/234–237; 70/164; 156/196
See application file for complete search history.

(56) References Cited

U.S. PATENT DOCUMENTS

| | | | | |
|---|---|---|---|---|
| 1,495,205 | A * | 5/1924 | Ruppel | 156/196 |
| D338,951 | S * | 8/1993 | Witzig | D23/311 |
| 6,321,580 | B1 * | 11/2001 | Olson | 70/164 |
| 6,347,415 | B1 * | 2/2002 | Hogue | 4/234 |
| D478,378 | S * | 8/2003 | Svendsen et al. | D23/311 |
| 2003/0024036 | A1 * | 2/2003 | Toldo et al. | 4/237 |
| 2003/0028955 | A1 * | 2/2003 | Hsieh | 4/234 |
| 2004/0226082 | A1 * | 11/2004 | Squicciarini | 4/234 |
| 2006/0156463 | A1 * | 7/2006 | Kitano et al. | 4/420.4 |
| 2006/0206999 | A1 * | 9/2006 | Meyer | 4/242.1 |
| 2008/0201835 | A1 * | 8/2008 | Ueno et al. | 4/410 |
| 2011/0004987 | A1 * | 1/2011 | Deng | 4/229 |
| 2011/0030133 | A1 * | 2/2011 | Morotomi et al. | 4/443 |

FOREIGN PATENT DOCUMENTS

| | | | |
|---|---|---|---|
| DE | 321219 | C | 5/1920 |
| DE | 29 12 820 | A1 | 10/1979 |
| DE | 202 03 205 | U1 | 5/2002 |
| FR | 2651667 | A1 * | 3/1991 |
| GB | 785510 | A | 10/1957 |
| GB | 2 021 176 | A | 11/1979 |
| GB | 2361941 | A * | 11/2001 |
| GB | 2 380 444 | A | 4/2003 |

OTHER PUBLICATIONS

Deffinition of the word 'Bush' The American Heritage Dictionary of the English Language, Fourth Edition copyright © 2000 by Houghton Mifflin Company. Updated in 2009. Published by Houghton Mifflin Company. All rights reserved.*

* cited by examiner

*Primary Examiner* — Brian Glessner
*Assistant Examiner* — Paola Agudelo
(74) *Attorney, Agent, or Firm* — Foley & Lardner LLP

(57) ABSTRACT

The invention concerns a toilet seat consisting of a seat (1) and a lid (2) capable of being hinge-mounted on it or actually hinge-mounted on it, whereby this lid (2) has a top cover (3) that may consist of sheets of veneer shaped along two axes and a bottom frame (4) consisting of a veneer bundle curved along one axis (FIG. 1*e*).

16 Claims, 3 Drawing Sheets

TOILET SEAT

Figure 1A:
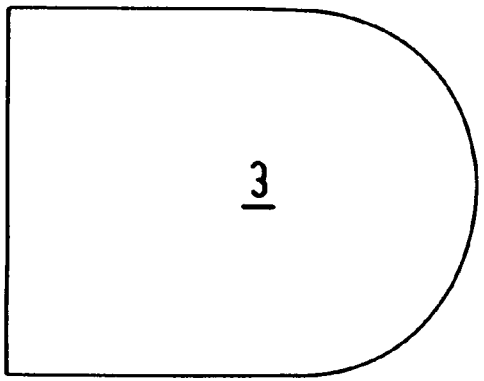
Figure 1B:
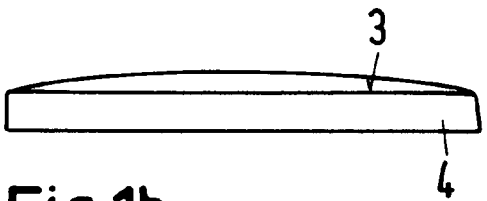
Figure 1C:
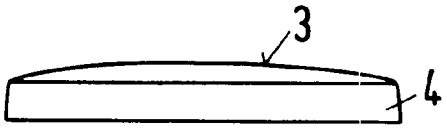
Figure 1D:
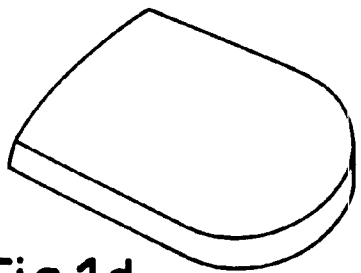
Figure 1E:
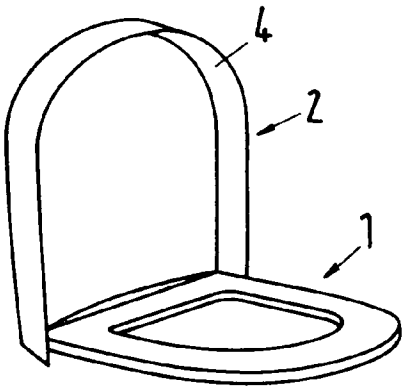

The invention concerns a toilet seat consisting of the seat and a lid capable of being hinge-mounted on it or actually hinge-mounted on it.

The seat and hinged lid of such toilet seats are usually made entirely of wood or plastic as so-called "sandwich lids".

From DE 29 12 820 C2 a hinged toilet lid is e.g. known, consisting of a solid plate made of a compression material involving the use of wood, whereby the edge of the hinged lid consists of a plastic frame surrounding the plate and forming an integral part of it, whereby this assembly features connecting parts integral with the plastic frame for the connection of the lid to the toilet bowl. The top of the plate made from the compression material can be covered with a plastic layer consisting of a transparent plastic in which a decorative film covering the top of the plate is embedded. The hinged lid should be cheap to manufacture and robust and at the same time provide a stable connection with the toilet bowl which remains serviceable and easy to clean for a long time. This also is a "sandwich lid" whereby the combination of plastic and compression material is not entirely satisfactory because of the different expansion coefficients.

From DE 202 03 205 we know a toilet lid with a main body of wood and enclosed in a protective layer which is made of a fibre-based or paper-based material with natural fibres and enclosed in an outer layer. A toilet lid of this type should be simple to manufacture cost-effectively in few manufacturing steps and present a pleasant appearance compared to toilet lids made of wood chips to which a fibre-based material has been applied, and painted toilet lids made of waste wood chips.

The purpose of the present invention is to create a so-called wooden toilet seat which appears to be made entirely of wood and which is simple to manufacture, sufficiently stable and easy to clean without adverse effects due to the different expansion coefficients of the materials used.

The invention in particular achieves this purpose with a toilet seat of the type described earlier by the fact that the lid, hinge-mounted on the seat or directly on the toilet bowl, features a top cover that may consist of sheets of veneer shaped along two axes and a bottom frame consisting of a veneer bundle curved along one axis. By using the veneer sheets and the curved veneer bundle, the hinged lid gives the impression of being entirely made of wood, whereby the lid, dependent on the shaping of the top cover and the frame, can be given a desired appearance while offering sufficient stability.

To achieve easier cleaning of he hinged lid the top cover can be equipped with an inner lid of e.g. thermosetting plastic which can be simply wiped clean with a moist cloth.

To avoid the adverse effects of different expansion coefficients of the veneer material of the top cover and the thermosetting plastic of the inner lid, the inner lid can be inserted into a circumferential groove on the inside of the U-shaped frame and possibly fixed in position by gluing.

It may furthermore facilitate cleaning if the inside of the frame is covered with a plastic layer.

From a manufacturing point of view it is advantageous if the frame is fixed in position with the top cover by means of a rebate around the outside edge of the top cover e.g. by gluing.

To achieve the desired increased stability and shaping of the top cover and/or the frame these can be made of a glued, compression-moulded and hardened veneer bundle.

As a further development of this inventive idea the middle layers of the veneer bundle preferably consist of wood veneers e.g. beech wood and the outer layer of wood veneer of the type of wood determining its appearance e.g. oak.

In order to avoid the impression of a "sandwich lid", the U-shaped frame of the closed lid is so dimensioned that as it projects downward from the outside circumference of the top cover, it encloses the seat and if hinged directly on the toilet bowl, the side of the top edge of the bowl.

As in this manner the impression is conveyed that the overall toilet seat is made of wood, the seat itself can be simply made of e.g. thermosetting plastic for cleaning purposes.

The stability afforded by the inner lid of the hinged lid makes it possible that on the underside of the rear edge of the inner lid there is provision for cartridges and bushes for the accommodation of fittings for mounting and/or hinging on the seat and/or the toilet bowl, e.g. hinges, dampers and quick-mounting elements, a feature not possible with lids entirely made of wood.

Further purposes, characteristics and applications of the invention will be clear from the following description of embodiments with reference to the drawings. All features described and/or presented pictorially represent singly or in any combination the subject of the invention, also independent of their summary in individual claims or their cross-reference.

ILLUSTRATIONS

FIG. 1*a* to 1*e* Top view, side view, front view and oblique view of a toilet seat as proposed by the invention, also in open position.

Figure 2A:
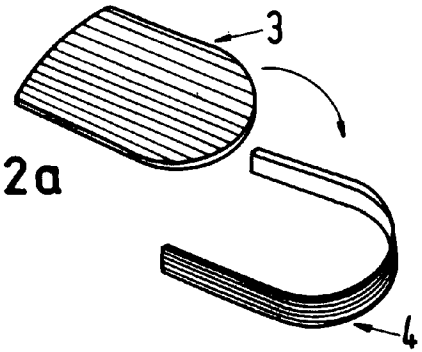
Figure 2B:
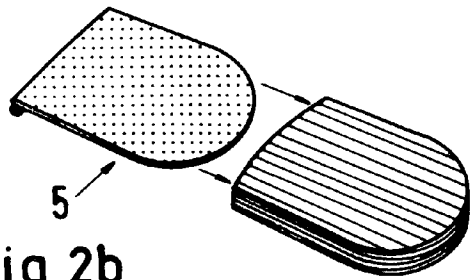
Figure 2C:
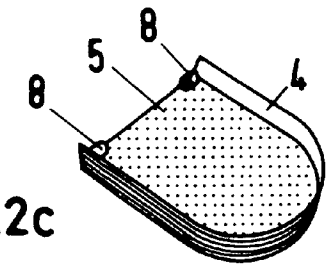

FIG. 2*a* to 2*c* Sectional view of the step-by step assembly of a hinged lid consisting of top cover, frame and inner lid as per invention.

Figure 3A:
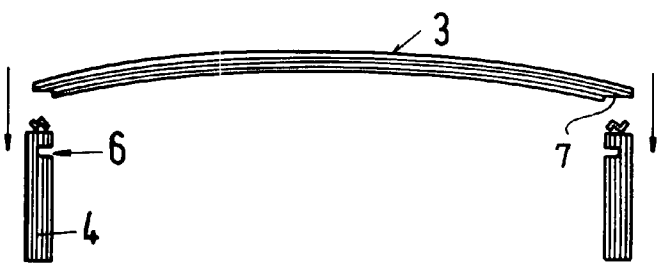
Figure 3B:
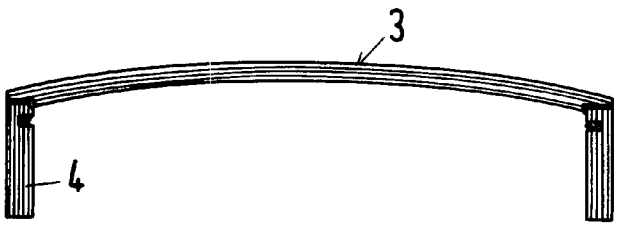
Figure 3C:
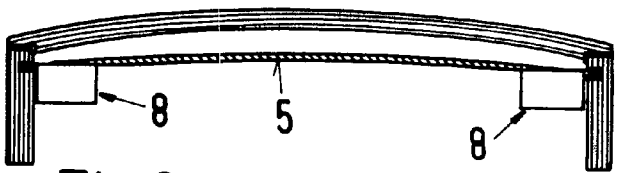

FIG. 3*a* to 3*c* Sectional view of the individual steps in the assembly of the hinged lid as per invention.

Figure 5A:
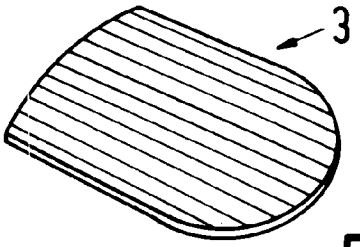
Figure 5B:
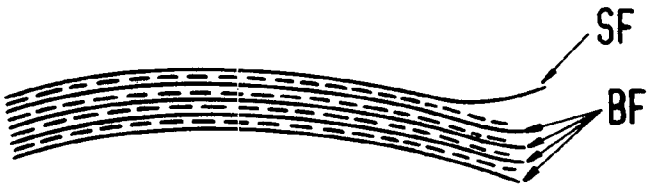
Figure 4A:
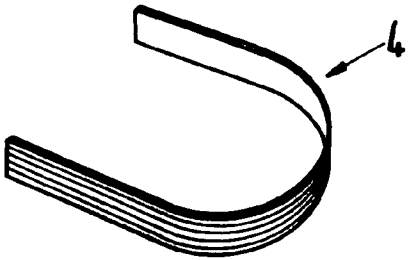
Figure 4B:
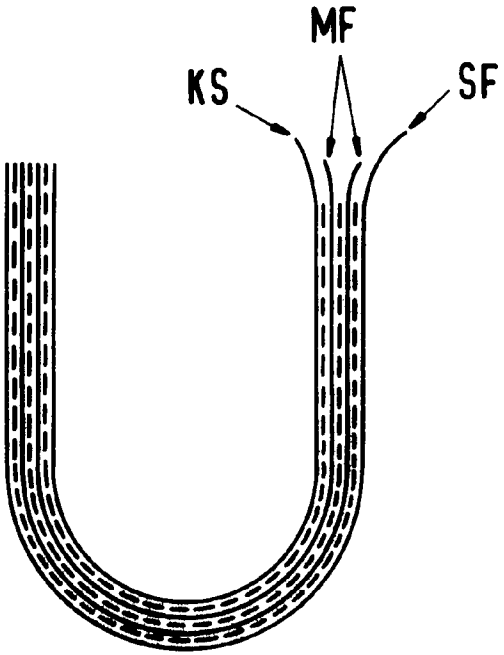

FIGS. 4*a* and 4*b* Oblique view of the frame of a hinged lid as per invention as shown in FIG. 1 and a diagram of the layer structure of such a frame, and FIGS. 5*a* and 5*b* Oblique view of the top cover of a hinged lid as per invention and the layer structure of the top cover.

The toilet seat shown in FIG. 1*a* to 1*e* consists in the case illustrated of a seat 1 and a hinged lid 2 mounted on it at the rear. The hinged lid 2, which may also be mounted on a toilet bowl (not shown), has a top cover 3 and a circumferential U-shaped frame 4 projecting downwards at the outside edge of the top cover 3. The top cover 3 may consist of veneer sheets that may according to the desired curvature have been shaped along two axes and the frame 4 consists of a curved veneer bundle which may have been shaped into the desired form e.g. the U-shape as shown along one axis.

The cleaning of the hinged lid 2 is facilitated by the fact that as shown in FIGS. 2*a* to 2*c*, the top cover 3 is equipped with an inner lid 5 of thermosetting plastic. The inner lid 5 is inserted into a circumferential groove 6 on the inside of the U-shaped frame 4 and may if necessary be secured by gluing if a press fit is not sufficient. The frame 4 is fixed to the top cover 3 as shown in FIGS. 3*a* to 3*c* in a rebate 7 at the outside circumference of the top cover 3 and in particular glued in place as shown. In order to facilitate easy cleaning of the inside area of the frame 4 below the groove 6, the frame 4 may be covered with a laminated plastic as shown in FIG. 4*b*. For the rest the top cover 3 and/or the frame 4 as illustrated in FIGS. 4*b* and 5*b* consist of a glued compression-moulded and hardened veneer bundle. The middle layers of the veneer bundle may be of wood veneer, e.g. beech wood and the outside layer of wood veneer of the desired visible type of wood e.g. of oak.

Because of the height of the frame 4 the ring 1 may be made of a thermosetting plastic, because it will be covered and the toilet seat 2 gives the overall impression of being made of wood.

The constructional stability derived from the design of the hinged lid 2 makes it possible that on the underside of the rear edge of the inner lid 5 there is provision for cartridges (see FIG. 2*c*) or bushes 8 for the accommodation of fittings for mounting and/or hinging on the seat 1 and/or the toilet bowl, e.g. hinges, dampers and quick-mounting elements.

REFERENCE LIST

1 Seat
2 Hinged lid
3 Top cover
4 Frame
5 Inner lid
6 Groove
7 Rebate
8 Cartridges/bushes
KS Laminated plastic
MF Wood veneer, in particular beech wood veneer
SF Face veneer, in particular oak veneer

The invention claimed is:

1. A toilet seat consisting of:
a seat; and
a lid hinge-mounted on the seat,
wherein the lid includes:
a top cover consisting of wood veneer sheets having a curvature shaped along two axes, and
a bottom frame consisting of a wood veneer bundle curved along one axis,
wherein the top cover includes an inner lid,
wherein the inner lid is configured to insert into a circumferential groove on an inside of the bottom frame and is configured to be fixed in position by gluing, and
wherein the bottom frame comprises a U-shaped frame.

2. The toilet seat of claim 1, wherein the inside of the bottom frame is covered with a plastic layer.

3. The toilet seat of claim 1, wherein the bottom frame is fixed in position with the top cover by a circumferential surface around an outside edge of the top cover.

4. The toilet seat of claim 1, wherein the bottom frame comprises a glued, compression-moulded and hardened veneer bundle.

5. The toilet seat of claim 4,
wherein middle layers of the wood veneer bundle include a first type of wood veneers and an outer layer of wood veneer includes a second type of wood veneer, and
wherein the outer layer of wood veneer is different from the first type of wood veneers.

6. The toilet seat of claim 1, wherein the bottom frame is configured to enclose a side of a top edge of a toilet bowl when the lid is closed.

7. The toilet seat of claim 1, wherein the seat comprises plastic.

8. The toilet seat of claim 1,
wherein the inner lid includes a rear edge having an underside, and
wherein the underside of the rear edge of the inner lid includes cartridges or bushings for accommodation of fittings for at least one of mounting and hinging on at least one of the seat and a toilet bowl.

9. A toilet seat comprising:
a seat; and
a lid hinge-mounted on the seat,
wherein the lid comprises:
a top cover comprising wood veneer sheets having a curvature shaped along two axes, and
a bottom frame comprising a wood veneer bundle curved along one axis,
wherein the top cover comprises an inner lid,
wherein the inner lid is configured to insert into a circumferential groove on an inside of the bottom frame, and
wherein the bottom frame comprises a U-shaped frame.

10. The toilet seat of claim 9, wherein the inside of the bottom frame is covered with a plastic layer.

11. The toilet seat of claim 9, wherein the bottom frame is fixed in position with the top cover by a circumferential surface around an outside edge of the top cover.

12. The toilet seat of claim 9, wherein at least one of the top cover and the bottom frame comprises a glued, compression-moulded and hardened veneer bundle.

13. The toilet seat of claim 12,
wherein middle layers of the wood veneer bundle include a first type of wood veneers;
wherein an outer layer of wood veneer includes a second type of wood veneer, and
wherein the outer layer of wood veneer is different from the first type of wood veneers.

14. The toilet seat of claim 9, wherein the bottom frame is configured to enclose a side of a top edge of a toilet bowl when the lid is closed.

15. The toilet seat of claim 9, wherein the seat comprises plastic.

16. The toilet seat of claim 9,
wherein the inner lid includes a rear edge having an underside, and
wherein the underside of the rear edge of the inner lid includes cartridges or bushings for accommodation of fittings for at least one of mounting and hinging on at least one of the seat and a toilet bowl.

* * * * *